United States Patent [19]
Itakura et al.
[11] 4,311,729
[45] Jan. 19, 1982

[54] METHOD FOR MANUFACTURING A CERAMIC ELECTRONIC COMPONENT BY ELECTROLESS METAL PLATING

[75] Inventors: Gen Itakura, Hirakata; Hideki Kuramitsu, Neyagawa; Yamato Takada, Katano; Takayuki Kuroda, Nishinomiya; Yoshio Irie, Nara, all of Japan

[73] Assignee: Matsushita Electric Industrial Co., Inc., Osaka, Japan

[21] Appl. No.: 116,963

[22] Filed: Jan. 30, 1980

Related U.S. Application Data

[63] Continuation of Ser. No. 874,763, Feb. 3, 1978, abandoned.

[30] Foreign Application Priority Data

Feb. 9, 1977 [JP] Japan ..... 52-13800

[51] Int. Cl.³ ..... H01C 17/18; C23C 3/02

[52] U.S. Cl. ..... 427/80; 427/92; 427/101; 427/102; 427/103; 427/383.5; 427/261; 427/126.2; 427/343

[58] Field of Search ..... 427/79, 80, 101–103, 427/92, 383.5, 88, 89

[56] References Cited

U.S. PATENT DOCUMENTS

| | | | |
|---|---|---|---|
| 2,757,104 | 7/1956 | Howes | 427/125 |
| 3,473,958 | 10/1969 | Waku | 427/88 |
| 3,586,534 | 6/1971 | Nitta et al. | 427/92 |
| 3,607,389 | 9/1971 | Canegallo et al. | 427/305 |
| 3,905,006 | 9/1975 | Matsuoka | 338/21 |
| 3,932,694 | 1/1976 | Hamaguchi et al. | 427/305 |
| 3,985,919 | 10/1976 | Pinch | 427/101 |
| 4,007,063 | 2/1977 | Yasuda et al. | 427/101 |
| 4,014,822 | 3/1977 | Fujikawa et al. | 252/520 |
| 4,022,716 | 5/1977 | Yeoka | 106/73.31 |
| 4,131,692 | 12/1978 | Seebacher | 427/102 |

FOREIGN PATENT DOCUMENTS

| | | | |
|---|---|---|---|
| 2533524 | 3/1977 | Fed. Rep. of Germany | 427/305 |
| 1330010 | 9/1973 | United Kingdom . | |

*Primary Examiner*—John D. Smith
*Attorney, Agent, or Firm*—Stevens, Davis, Miller & Mosher

[57] ABSTRACT

Method for manufacturing a ceramic electronic component such as a voltage-dependent non-linear resistor element and a semiconductive ceramic capacitor is disclosed, in which a precisely uniform metal coating is formed on a surface of a ceramic and the metal coating is then heat treated to convert the metal of the metal coating to a metal compound to form a metal compound coating on the surface of the ceramic and/or diffuse a portion of or all of the metal coating into the ceramic, for attaining completely different electric properties than those of untreated ceramic. The present method is particularly useful in the application to a semiconductive ceramic capacitor.

12 Claims, 2 Drawing Figures

Figure 1:
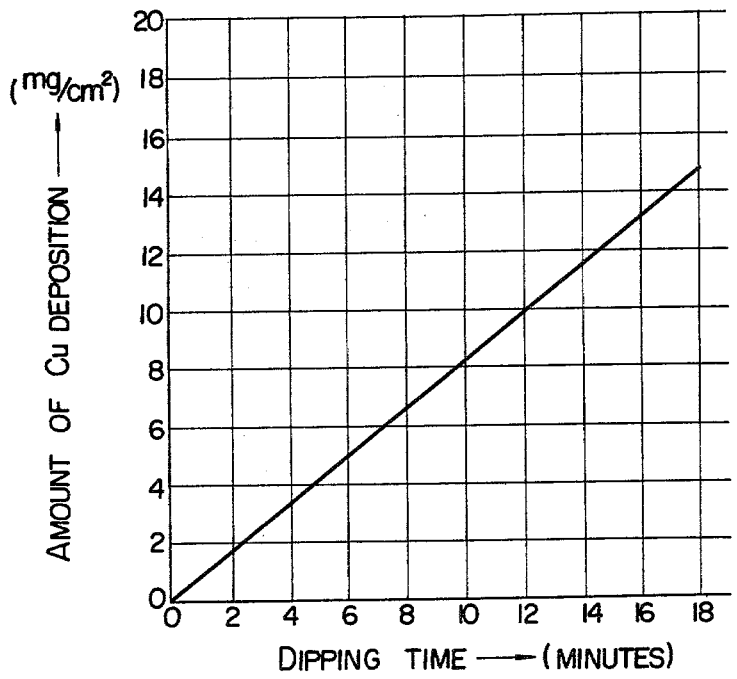

METHOD FOR MANUFACTURING A CERAMIC ELECTRONIC COMPONENT BY ELECTROLESS METAL PLATING

This is a continuation of application Ser. No. 874,763, filed Feb. 3, 1978, now abandoned.

The present invention relates to a method for manufacturing a ceramic electronic component such as voltage-dependent non-linear resistors or intergranular barrier layer dielectrics or capacitors, which method enables the attainment of completely different electric properties than those of untreated material by forming a uniform metal coating on a surface of a ceramic by electroless plating or the like, converting the metal of the metal coating to a metal compound by heat treatment to form a metal compound coating on the surface of the ceramic and/or diffuse a portion of or all of the metal compound into the ceramic.

Many of the ceramic electronic components do not consist of a single composition, but they comprise of a sintered body of composite composition including various additives to attain a desired electrical characteristic. Very frequently, however, several kinds of inorganic oxides or carbonates are dispersed, either singly or in mixture, or sometimes in the form of glass, into an organic binder and applied on the surface of the sintered body, which is then heat-treated to remove the glass binder and form a protective coating on the surface of the sintered body, or inorganic material is diffused into the sintered body in order to attain a desired electrical characteristic or improve an electrical characteristic.

A typical example of prior art methods in which the inorganic material is applied on the sintered body and heat treated to improve the characteristic is the manufacture of a voltage-dependent, non-linear, zinc oxide based resistor element, that is, a zinc oxide varistor (also called voltage-dependent varistor). The zinc oxide varistor basically comprises a sintered body manufactured by preparing a mixture of zinc oxide and a small amount of additives such as bismuth oxide, cobalt oxide, manganese oxide and chromium oxide, and molding and sintering the mixture. In order to improve the durability and the humidity-proof property, oxides of boron, silver and bismuth, either in the form of mixture or glass, are applied on the surface of the sintered body and thermally diffused. When the zinc oxide variator is used in an arrestor, an inorganic material is applied on those sides thereof which are perpendicular to an electrode to prevent the deterioration due to creeping discharge.

A typical example for attaining a desired characteristic is, intergranular barrier layer dielectrics mainly comprising barium titanate, strontium titanate, or composite compound thereof, as disclosed in U.S. Pat. Nos. 3,074,804, 4,014,822, 3,069,276, 3,294,688, 3,427,173, 3,673,119, 3,764,529 and 4,022,716. The intergranular barrier layer dielectric comprises, in addition to the compound described above, oxide of pentavalent metal such as tantalum (Ta) or niobium (Nb) as promoting agent for semiconductorization and several additives depending on specific requirements. It basically comprises a sintered body formed in a reducing atmosphere, that is, a semiconductive ceramic but it is useful as a capacitor only when a paste comprising an organic binder into which an oxide of copper or manganese was dispersed has been applied on the surface of the semiconductive ceramic and the semiconductive ceramic has been heat-treated in an atmosphere to diffuse the copper or manganese into the intergranular barrier layer to form an insulative layer in the intergranular barrier layer.

As described above, it is frequently essential to apply a material including metal oxide on the surface of the sintered body and heat-treat the same to form a composite body with the basic ceramic.

Heretofore, when the paste including a desired coating material (such as metal oxide) is to be applied to the surface of the sintered body, a screen printing technique has been employed. As the amount of treatment in mass-production increases, however, this technique raises a problem in the manufacture because of ununiformity of printing, reduction of yield, increase of the process time (i.e., decrease of the rate of production) and the necessity of heat-treatment process for removing the binder. Furthermore, no appropriate method of application of the paste has been known for a sintered body having a curved surface and a complex shape rather than a plane surface. The best known manufacturing method is a so-called dipping method in which the sintered body is dipped in a dispersion including a desired coating material, and then it is picked up and dried. This method, however, involves problems in that it results in ununiformity of coating, and in addition if the sintered bodies are overlapped to each other before they are dried, the coating on the overlapped area is removed off or the sintered bodies stick together after drying. Accordingly, this method is disadvantageous with respect to yield and the process time.

The present invention is directed to solve the above problems. According to the present invention, instead of using the composite body of the metal and the ceramic manufactured by forming the metal coating on the surface of the ceramic and heat-treating the same, a precisely uniform coating of metal is formed on the ceramic surface, and the metal of the metal coating is converted by heat-treatment to a metal compound to form a metal compound coating on the surface of the ceramic and/or diffuse a portion of or all of the metal compound into the ceramic to alter the electric property of a portion of or the whole of the ceramic.

Figure 2:
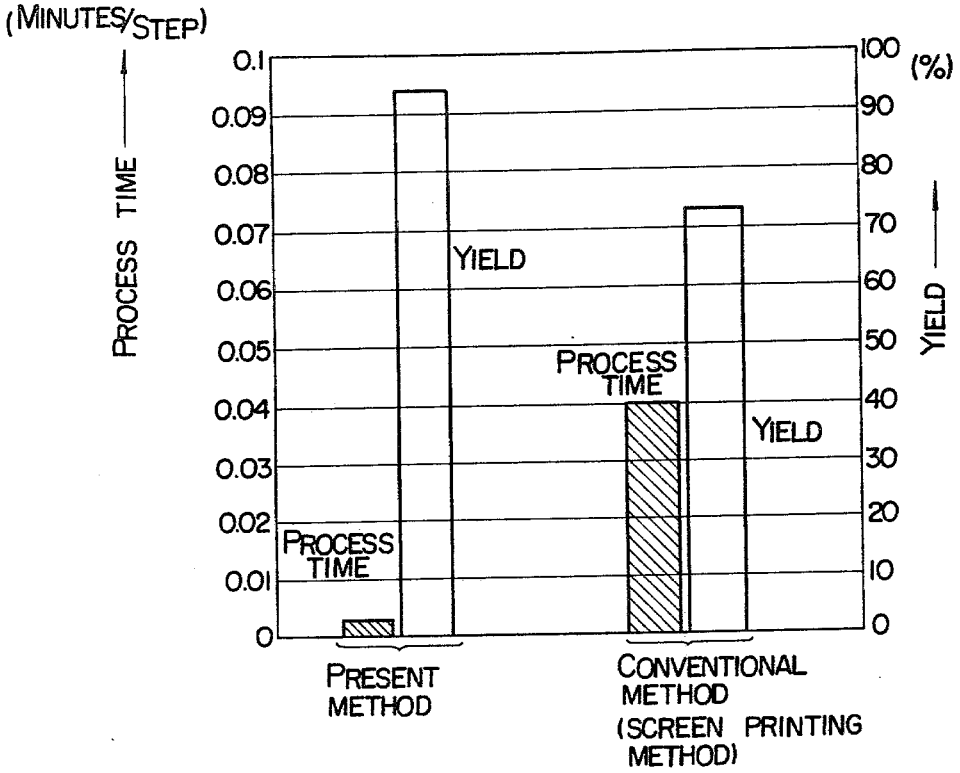

The above and other objects, features and advantages of the present invention will be apparent from the following description of the preferred embodiments of the invention when taken in conjunction with the accompanying drawings, in which:

FIG. 1 shows a chart illustrating a relation between a dipping time and the amount of copper deposited on a body of ceramic material in electroless plating of copper in accordance with one embodiment of the present invention; and FIG. 2 shows a comparative chart of the process time and yield for a conventional screen printing method and the present method.

The present invention will now be explained with reference to the examples thereof.

EXAMPLE 1

Application to a voltage-dependent, non-linear, zinc oxide based resistor element:

Added to zinc oxide (ZnO) were bismuth oxide ($Bi_2O_3$), cobalt oxide (CoO), manganese oxide (MnO) and antimony oxide ($Sb_2O_3$) in the range of 0.01 to 10 mol %, respectively. After fully blended, the mixture was compression-molded to a disc of 20 mm in diameter and 1.0 mm in thickness. It was then fired at a temperature of 800° to 1500° for 1 to 5 hours in the atmosphere to form a zinc oxide based sintered body.

Table 1 shows properties of the sintered body after having treated in different ways. In the table, row A shows the properties for a non-treated sintered body, row B shows the properties for the sintered body which was heat-treated in air at 800° to 1200° C., for 0.5 to 5 hours, row C shows the properties for the sintered body to which a paste including silver oxide was applied by dipping method to form a silver oxide coating of 0.10 to 0.30 mg/cm$^2$ and which was heat-treated in air at the same temperature as in the row B, and row D shows the electric properties for the sintered body to which silver was plated 10 to 50 μm in thickness by Brasher method and which was then heat-treated in the atmosphere at the same temperature as in the row B to convert the plated silver into silver oxide ($Ag_2O$).

The electrodes used were made of indium-gallium alloy, which were provided on both sides of the disc. 1000 samples were used for each example and mean value $\overline{X}$ and sample variance thereof are listed in the Table.

TABLE 1

| Properties | $V_1$ mA/mm (volts) | | α | | $\Delta V_1$ mA/$V_1$ mA (%) | |
|---|---|---|---|---|---|---|
| Type | $\bar{x}$ | σ | $\bar{x}$ | σ | $\bar{x}$ | σ |
| A | 186 | 11 | 47 | 8 | 49 | 23 |
| B | 175 | 13 | 37 | 5 | 27 | 16 |
| C | 191 | 26 | 45 | 12 | 4.8 | 2.3 |
| D | 196 | 5.9 | 51 | 7 | 3.1 | 0.7 |
| E | 0 | — | — | — | — | — |

$\bar{x}$: the mean value
σ: the sample variance
$V_1$ mA/mm: the varistor voltage
α: the index of voltage non-linearity
$\Delta V_1$ mA/$V_1$ mA: the rate of change of varistor voltage after voltage test.

As is apparent from the Table 1, when the silver oxide was thermally diffused or silver was plated followed by thermal diffusion, the sintered body shows smaller change after the voltage test and longer durability than when it was not treated or simply heat-treated. The voltage test was carried out by applying 0.8 watt power for 1000 hours at 95% relative humidity and 70° C. surrounding temperature. It is readly recognized from the comparison of the sample variance of the properties for the plating method and the application method that the plating method apparently provides smaller variance in the property. Row E in the table shows the properties for the sintered body which was simply plated with silver without any subsequent treatment. It is apparent that such a sintered body can function only as a resistor but not as a varistor.

As explained above, it is apparent that the method of plating silver on the surface of the sintered, zinc oxide based body by electroless plating and heat-treating the same can provide a uniform property and maintain the property in a stable manner over a long period of time.

EXAMPLE 2

Application to an intergranular barrier layer type, strontium titanate based semiconductive ceramic capacitor:

Added to strontium titanate ($SrTiO_3$) were 0.1 to 2.0 mol % of niobium oxide ($Nb_2O_5$) and 0.1 to 2.0 mol % of bismuth oxide ($Bi_2O_3$). After blending, the mixture was compression-molded to a disc of 15 mm in diameter and 0.7 mm in thickness. It was then fired in an atmosphere consisting of 1 to 10% of hydrogen and 99 to 90% of nitrogen at 1370° to 1460° C. for 2 to 4 hours, to form a semiconductive ceramic.

Table 2 shows properties of the sinteread bodies (namely, discs) treated in different ways. The electrode used was a silver electrode. To form the electrodes, silver paste was baked through screen printing process on both opposite surfaces of the sintered disc at 800° to 900° C. for 10 to 30 minutes.

TABLE 2

| Properties | ε | | tan δ(%) | | ρ (Ω− cm) | |
|---|---|---|---|---|---|---|
| Type | $\bar{x}$ | σ | $\bar{x}$ | σ | $\bar{x}$ | σ |
| F | — | — | — | — | <1.0 | — |
| G | 35300 | 2250 | 0.73 | 0.090 | $1.5 \times 10^7$ | $2.1 \times 10^7$ |
| H | 27700 | 1270 | 0.35 | 0.047 | $2.3 \times 10^{11}$ | $4.5 \times 10^{10}$ |
| I | 28100 | 560 | 0.14 | 0.009 | $3.1 \times 10^{11}$ | $2.0 \times 10^{10}$ |
| J | — | — | — | — | <1.0 | — |

ε: the apparent dielectric constant
tan δ: the dielectric loss factor
ρ: the insulative resistance
$\bar{x}$: the mean value
σ: the sample variance In the Table 2, row F shows the properties for the sintered body on which the silver electrodes were mounted, row G shows the properties for the sintered body which was heat-treated at 900° to 1200° C. for 1 to 5 hours and on which the silver electrodes were mounted, row H shows the properties for the sintered body on which cuprous oxide $Cu_2O$ was screen-printed and which was then heat-treated at the same temperature as in the row G, and row I the properties for the sintered body on which copper was electroless-plated and which was then heat-treated at the same temperature as in the row G.

Row J shows the properties for the sintered body on which copper was plated and indium-gallium alloy electrodes were mounted. One thousand samples were tested for each example and mean value and sample variances thereof are listed in the Table 2.

It is apparent from the Table 2 that the sintered body having cuprous oxide thermally diffused and the sintered body having copper plated and thermally diffused in the form of copper oxide show superior performance as a capacitor to others. Further, it is apparent from the comparison of the sample variance of the properties for the sintered body having cuprous oxide applied and the sintered body having copper plated, the copper plated sintered body shows much less variation in properties.

As explained above, it is seen that the sintered body manufactured by electroless-plating copper on the semiconductive ceramic and heat-treating the same shows very stable electric properties. This is because the electroless plating method can precisely define the amount of copper deposited and assure less variation or evenness in the amount (thickness or weight) of deposition or coating than the conventional application method.

The amount of deposition in electroless plating is readily determined by dipping time for a given type of plating bath, a given pH thereof and a given temperature thereof. FIG. 1 shows a relation between the amount of copper deposition and the dipping time for a strontium titanate semiconductive ceramic. The plating bath used was prepared by dissolving 7.7 g of copper nitrate, 150 g of potasium sodium tartrate, 10.0 g of caustic soda and 5.0 g of sodium bicarbonate in 1 litter of pure water with 0.025% of formalin (HCHO 37% aqueous solution) relative to the volume of plating solution being added as reducing agent. The plating bath temperature was 35° C.

The workability for the application method and the electroless plating method is now discussed.

The operation of coating the semiconductive ceramic with copper or cuprous oxide according to the Example 2 was done by a single person to determine the workability. One was done by the conventional screen printing method and the other was done by electroless plating method. The operations were done for one hour, respectively, after the completion of the preparation of the respective processes.

The characteristics of the semiconductive ceramic capacitors formed by the respective methods were measured and the yields thereof were calculated.

FIG. 2 shows the process time and the yield. It is apparent from FIG. 2 that the electroless plating method provides excellent workability and excellent yield.

In the Examples 1 and 2 described above, the metal coating was formed on the surface of the ceramic by electroless plating. Examples for forming a metal coating on the surface of the ceramic by injection-welding (which is usually called "metal spraying" or "metallikon") such as plasma are coating process, metallizing process and thermospraying process are now explained.

EXAMPLE 3

Application to a voltage-dependent, non-linear, zinc oxide based resistor element:

A zinc oxide based sintered body which is similar to that of the Example 1 was prepared. Silver was injection-welded on the sintered body, which was then heat-treated at the same temperature as in the Example 1.

Substantially the same properties as those of the row D in the Example 1 (silver electroless plating followed by heat-treatment) were obtained. More particularly, the mean values and the sample variance of the varistor voltage $V_1$ mA/mm, the voltage non-linearity index $\alpha$, and the rate of change of the varistor voltage after the voltage test $\Delta V_1$ mA/$V_1$ mA, respectively, were measured in the same manner as in the Example 1. The results are shown below:

$V_1$ *mA/mm* (volts);

$\bar{x}$: 198, $\sigma$: 6.0

$\alpha$;

$\bar{x}$: 50, $\sigma$: 7

$\Delta V_1$ *mA/*$V_1$ *mA* (%);

$\bar{x}$: 3.2, $\sigma$: 0.8

It is apparent from the above results that the method of forming the silver coating in an amount of 0.1 to 0.3 mg/cm$^2$ on the surface of the zinc oxide based sintered body by injection-welding and heat-treating the same can provide uniform electric properties and maintain the properties in a stable manner over a long period of time.

EXAMPLE 4

Application to an intergranular barrier layer type, strontium titanate based semiconductive ceramic capacitor;

A strontium titanate based semiconductive ceramics which is similar to that in the Example 2 was prepared. Copper was injection-welded or metallized on the surface of the sintered body 0.10–0.30 mg/cm$^2$ and it was heat-treated at the same temperature as in the row G of the Example 2.

Substantially the same properties as those of the row I in the Example 2 (copper electroless plating followed by heat-treatment) were obtained. More particularly, the mean values and the sample variance of the apparent dielectric constant $\epsilon$, the dielectric loss factor tan $\delta$ and the insulative resistance $\rho$, respectively, were measured. The results are shown below:

$\epsilon$;

$\bar{x}$: 28000, $\sigma$: 630 tan $\delta$(%);

$\bar{x}$: 0.16, $\sigma$: 0.011

$\rho$ ($\Omega \cdot$ cm);

$\bar{x}$: $3.0 \times 10^{11}$, $\sigma$: $2.2 \times 10^{10}$

It is apparent from the above results that the sintered body having copper injection-welded and thermally diffused in the form of copper oxide exhibits an excellent characteristic as a capacitor. It is also apparent from the sample variance that the sintered body thus manufactured shows small variation in properties.

It is thus seen that the sintered body manufactured by applying copper to the ceramic by injection-welding and heat-treating the same as very stable properties. This is because the injection-welding method can precisely define the amount of copper deposited (namely, the method can make the thickness of copper deposited uniform), like the electroless plating method and assure much less variation in the amount of deposition than the conventional plating method. The amount of copper deposition by injection-welding is easily controllable and is readily determined by the injection-welding time for a given diameter of copper wire, a given applied voltage, a given feed rate of the copper wire and a given distance between an object to be metallized and an injection port.

The workability of the injection-welding method was measured. Like in the electroless plating method, the workability is excellent and the yield is also excellent.

Examples for forming the metal coating on the surface of the ceramic by vacuum-deposition are now explained.

EXAMPLE 5

Application to a voltage-dependent, non-linear, zinc oxide based resistor element:

A zinc oxide based sintered body which is similar to that in the Example 1 was prepared. Silver was vacuum-deposited on the surface of the sintered body and it was heat-treated at the same temperature as in the row B of the Example 1. The properties were measured in the same manner as in the Example 1. The results are shown below:

$V_1$ *mA/mm* (volts);

$\bar{x}$: 193, $\sigma$: 5.5

$\alpha$;

$\bar{x}$: 53, $\sigma$: 7

-continued $\Delta V_1\ mA/V_1\ mA$ (%);

$\bar{x}$: 2.9, $\sigma$: 0.8

It is seen from the above results that substantially the same properties as those by the electroless plating method or the injection-welding method can be attained.

EXAMPLE 6

Application to an intergranular barrier layer type, strontium titanate based semiconductive ceramic capacitor:

A strontium titanate based semiconductive ceramic which is similar to that in the Example 2 was prepared. A copper coating was formed on the surface of the sintered body by vacuum-deposition and it was then heat-treated at the same temperature as in the row G of the Example 2. The properties were measured in the same manner as in the Example 2. The results are shown below:

$\epsilon$;

$\bar{x}$: 27300, $\sigma$: 540 tan $\delta$(%);

$\bar{x}$: 0.18, $\sigma$: 0.015

$\rho$ ($\Omega \cdot$ cm);

$\bar{x}$: $3.3 \times 10^{11}$, $\sigma$: $2.6 \times 10^{10}$

It is apparent from the above results that the sintered body having copper vacuum-plated and thermally diffused in the form of copper oxide shows an excellent characteristic as a capacitor, and it is also apparent from the standard deviation that it exhibits small variation in properties.

It is thus seen that the semiconductive ceramics having copper vacuum-deposited and thermally diffused in copper oxide form exhibits very stable characteristic. This is because the vacuum-deposition method can precisely define the amount of copper deposited like the electroless plating method and the injection-welding method. The amount of copper deposition can be readily determined by the amount of current supplied to a heating source and the time.

As described above, according to the present method, a precisely uniform coating of metal is formed on the surface of the ceramic and then heat-treated to convert the metal of the metal coating to a metal compound such as metal oxide to form the metal compound coating on the surface of the ceramic and/or diffuse a portion of or all of the metal compound into the ceramic for attaining completely different electric properties than those of untreated ceramic. Accordingly, the present method contributes to the development of new field and is of high value in the field of science and technology. Furthermore, by the application of the electroless plating technique, the injection-welding technique and the vacuum-deposition technique, the amount of material which is secondarily added to the sintered body can be precisely determined and the precise determination of the ceramic composition, which could not be attained by the conventionally used coating methods described above, is now attained, and the workability is improved. Accordingly, the present method is suited for mass production.

While the voltage-dependent, non-linear, zinc oxide based resistor element and the strontium titanate based semiconductive ceramic capacitor were described in the above examples, it should be understood that the present method can be applied to other ceramic electronic components to simply change the characteristics thereof. Specifically, it has been proved that the same effects as those attained by the strontium titanate based ceramic capacitor could be attained by a barium titanate based ceramic capacitor and a semiconductive ceramic capacitor mainly comprising composite compound of strontium titanate and barium titanate.

Furthermore, while silver and copper were used as the metal coating formed on the surface of the ceramic in the above examples, any other metals which can change the characteristic of the ceramic electronic component may be used. Such metals may include at least one of those which can be electroless plated, injection-welded (metallized) or vacuum-deposited, such as tin, chromium, zinc, nickel, cobalt, lead, bismuth, boron, iron, thallium and manganese.

It should also be understood that both electrodes of the present ceramic electronic components may be provided on the same surface of the ceramic in this invention.

What is claimed is:

1. A method for manufacturing a ceramic electronic component comprising the steps of forming through electroless plating a precisely uniform coating of metal over a surface of a ceramic body so that the amount of metal deposition is constant thereover; heat-treating the metal coating to form a metal oxide on the surface of said ceramic body whereby a portion of said metal oxide is diffused into said ceramic body; and providing at least two separate electrodes on portions of the surface of the ceramic body whereby ceramic electronic components are produced having uniform electrical characteristics with a relatively small sample variance.

2. A method for manufacturing a ceramic electronic component according to claim 1, wherein said ceramic body is a semiconductive ceramic.

3. A method for manufacturing a ceramic electronic component according to claim 2, wherein said semiconductive ceramic is a strontium titanate based semiconductive ceramic.

4. A method for manufacturing a ceramic electronic component according to claim 2, wherein said semiconductive ceramic is a barium titanate based semiconductive ceramic.

5. A method for manufacturing a ceramic electronic component according to claim 2, wherein said semiconductive ceramic is a strontium titanate-barium titanate composite compound based semiconductive ceramic.

6. A method for manufacturing a ceramic electronic component according to claim 2, wherein said semiconductive ceramic is a cuprous oxide based semiconductive ceramic.

7. A method for manufacturing a ceramic electronic component according to claim 1, wherein said metal coating formed on the surface of said ceramic includes at least one of tin, silver, chromium, zinc, copper, nickel, cobalt, lead, bismuth, boron, iron, talium and manganese.

8. A method for manufacturing a ceramic electronic component according to claim 1, wherein said ceramic is a zinc oxide based sintered body.

9. A method of manufacturing a non-linear voltage-dependent electronic component comprising the steps of:

(a) uniformly forming a coating of a metal over a surface of a ceramic body by electroless plating so that the resulting metal deposition is constant thereover;

(b) heat-treating the metal coated ceramic body to convert the metal coating into a metal oxide and simultaneously diffuse at least a portion of the metal oxide into the ceramic body; and (c) providing electrodes on a surface of said ceramic body, whereby an electronic component is produced having uniform electrical characteristics with a relatively small sample variance.

10. A method of making a non-linear voltage-dependent electronic component comprising the steps of:

(a) electroless plating a metal coating over a surface of a ceramic body so that the amount of metal dispersion is constant thereover;

(b) heat-treating the metal coated ceramic body to oxidize the metal coating and simultaneously diffuse at least a portion of the oxidized metal coating into said ceramic body; and (c) providing electrodes of the component on a surface of the ceramic body whereby an electronic component is produced having uniform electrical characteristics with a relatively small sample variance.

11. A method of making an intergranular barrier type semiconductive ceramic capacitor comprising the steps of:

(a) electroless plating a metal over a surface of a sintered semiconductive ceramic body to form a metal coating thereon so that the resulting metal deposition is constant thereover;

(b) heat-treating the metal plated ceramic body to oxidize the metal coating and simultaneously diffuse at least a portion of the oxidized metal coating into said ceramic body; and (c) providing metal electrodes for the capacitor on opposite surfaces of the ceramic body whereby an electronic component is produced having uniform electrical characteristics with a relatively small sample variance.

12. A method of making an intergranular barrier type semiconductive ceramic capacitor comprising the steps of:

(a) electroless plating copper on a strontium titanate based sintered ceramic body so that the resulting metal deposition is constant thereover;

(b) heat-treating said ceramic body at 900°-1200° C. for 1 to 5 hours; and (c) forming silver electrodes on opposite surfaces of the treated ceramic body whereby an electronic component is produced having uniform electrical characteristics with a relatively small sample variance.

* * * * *